United States Patent [19]

Peets

[11] 4,123,124

[45] Oct. 31, 1978

[54] CONVERTIBLE SEWING MACHINE CABINET

[75] Inventor: Robert S. Peets, Watchung, N.J.

[73] Assignee: The Singer Company, New York, N.Y.

[21] Appl. No.: 813,567

[22] Filed: Jul. 7, 1977

[51] Int. Cl.[2] ..... A47B 81/00

[52] U.S. Cl. ..... 312/21; 312/26; 312/30; 312/237; 112/217.1; 108/17

[58] Field of Search ..... 312/27, 21, 24, 26, 312/30, 306; 112/217.1, 258; 108/17, 90, 92

[56] References Cited

U.S. PATENT DOCUMENTS

| | | | |
|---|---|---|---|
| 517,843 | 4/1894 | Conde | 312/26 |
| 1,556,378 | 10/1925 | Topazzi | 312/30 |
| 2,103,091 | 12/1937 | Robert | 312/30 |
| 2,909,401 | 10/1959 | Bjorgan | 312/30 |
| 3,188,993 | 6/1965 | Szuba et al. | 112/258 |
| 3,384,037 | 5/1968 | Blevins | 312/26 |
| 3,726,237 | 4/1973 | Devey et al. | 108/17 |
| 3,806,217 | 4/1974 | Current | 312/30 |
| 3,946,682 | 3/1976 | Cowdrey et al. | 312/21 |
| 4,044,700 | 8/1977 | Aeschliman | 112/258 |
| 4,062,606 | 12/1977 | Peets | 312/21 |

FOREIGN PATENT DOCUMENTS

| | | | |
|---|---|---|---|
| 916,212 | 6/1954 | Fed. Rep. of Germany | 312/21 |

*Primary Examiner*—Victor N. Sakran

*Attorney, Agent, or Firm*—Robert E. Smith; Edward W. Goodman; Edward L. Bell

[57] ABSTRACT

A cabinet and work table for a sewing machine having a convertible work supporting bed capable of conversion from a flat work supporting bed to a free-arm bed. The cabinet work supporting surface is divided into two parts, a fixed rear work supporting surface and a laterally/vertically shiftable front work supporting surface. The sewing machine is supported in the cabinet with the work supporting bed forwardly of, contiguous with and spaced above the rear work supporting surface. The shiftable front work supporting surface may be shifted from a first position co-planar with the rear work supporting surface, wherein the sewing machine may be used in a free-arm mode, to a second position co-planar and contiguous to the work supporting bed of the sewing machine for the flat bed sewing mode, wherein the front work supporting surface augments the flat work supporting bed of the sewing machine.

3 Claims, 5 Drawing Figures

CONVERTIBLE SEWING MACHINE CABINET

BACKGROUND OF THE INVENTION

This invention relates to sewing machine cabinets, and more particularly, to those cabinets capable of supporting a sewing machine for free-arm use as well as flat bed use.

Many prior art cabinets which include this feature have mechanisms which raise the sewing machine to such a height as will allow free arm use. Besides being cumbersome and expensive to manufacture, these cabinets resulted in a departure from the optimum height for sewing when the sewing machine was raised.

U.S. Pat. No. 3,946,682 of Cowdrey et al, disclosed the use of a shiftable leaf which, when free arm use of this sewing machine is desired, may be pivotally swung down exposing the cylinder bed of the sewing machine. However, in use, this creates a ledge to the rear of the sewing machine against which the material being sewn could gather hindering easy handling of the material.

U.S. Pat. No. 3,384,037 of Blevins discloses a table for a portable sewing machine wherein a portion of the table top swings up enclosing the base of the sewing machine thereby extending the work supporting surface thereof. However, the swing up leaf must be formed to encircle the sewing machine base and this table is intended just to replace a standard drop head sewing machine cabinet where a recessed drop leaf supports a sewing machine in a position where the work supporting surface thereof is co-planar with the cabinet top.

SUMMARY OF THE INVENTION

The primary object of this invention is to provide a convertible sewing machine cabinet for convertible bed sewing machines which is easy to use, inexpensive to manufacture and allows free movement of the material being sewn. This object is achieved through the use of a sewing machine cabinet having a shiftable front work supporting surface wherein the sewing machine is brought up from a storage position to one in which its free arm is readily accessible and, when flat bed sewing is desired, the bed of the sewing machine is converted and the front work supporting surface is pivotally swung upward to a position co-planar and contiguous with the work supporting bed of the sewing machine. This principle is shown in a cabinet which when in the free arm sewing position has a flat work supporting surface, i.e., the front surface is co-planar with the rear surface eliminating any ledge against which the material being sewn may gather.

Another object of this invention is to provide a convertible sewing machine cabinet capable of accommodating all types of convertible bed sewing machines; i.e., free-arm sewing machines having a slide-on flat bed converter as well as convertible bed sewing machines having a pivotal bed extension. This object is achieved through the use of an upward shifting front work supporting surface which abuts only the front and the free end of the sewing machine bed. Therefore, either type of convertible bed sewing machine may be utilized therewith, varying only the position in which the sewing machine is mounted to the cabinet.

DESCRIPTION OF THE DRAWINGS

With the above and additional objects and advantages in view as will hereinafter appear, this invention will be described with reference to the following drawings of the preferred embodiment.

DESCRIPTION OF THE PREFERRED EMBODIMENT

Figure 1:
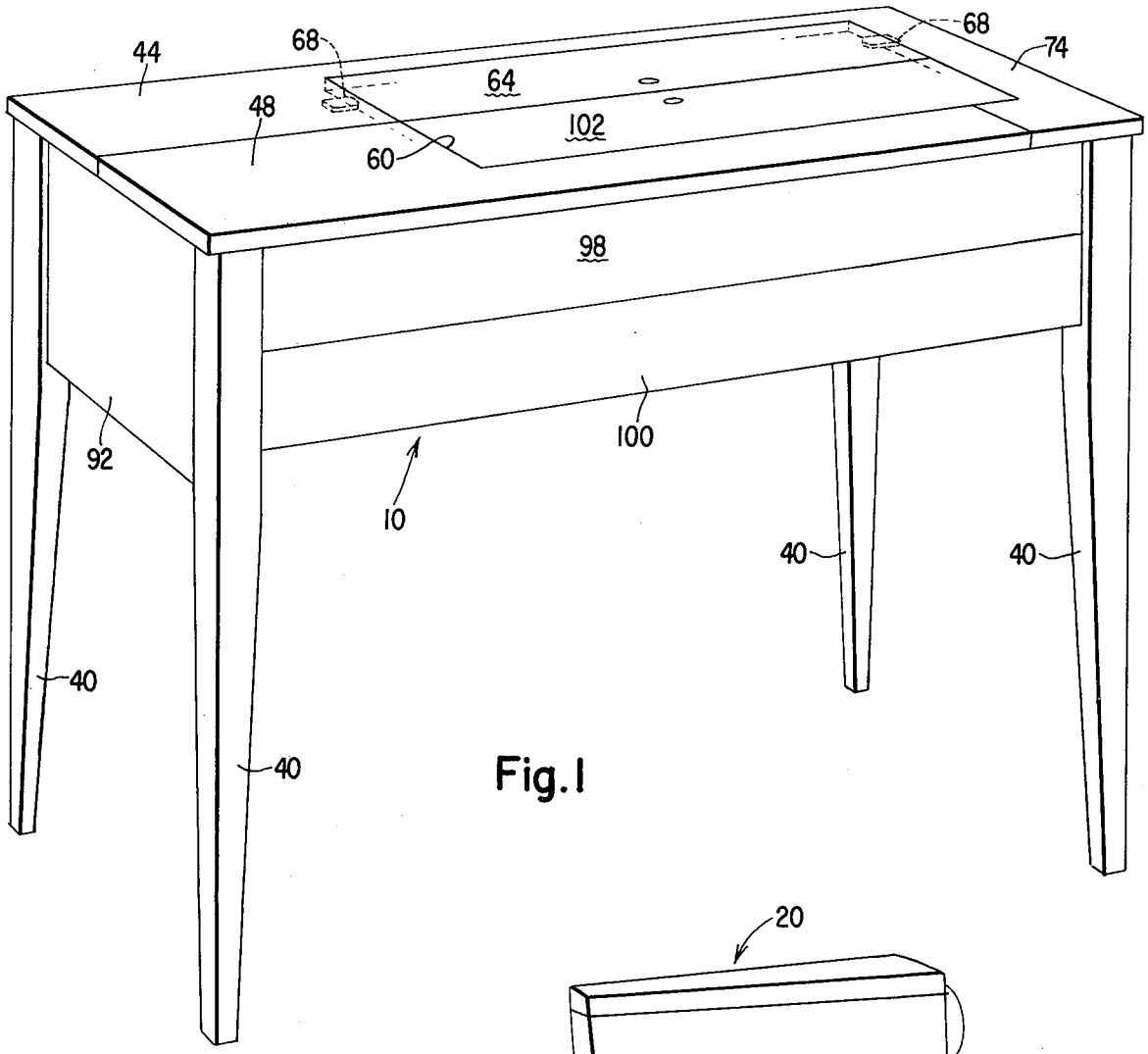
FIG. 1 is a front prospective view of a sewing machine cabinet incorporating the subject invention with the sewing machine in a storage position.
Figure 2:
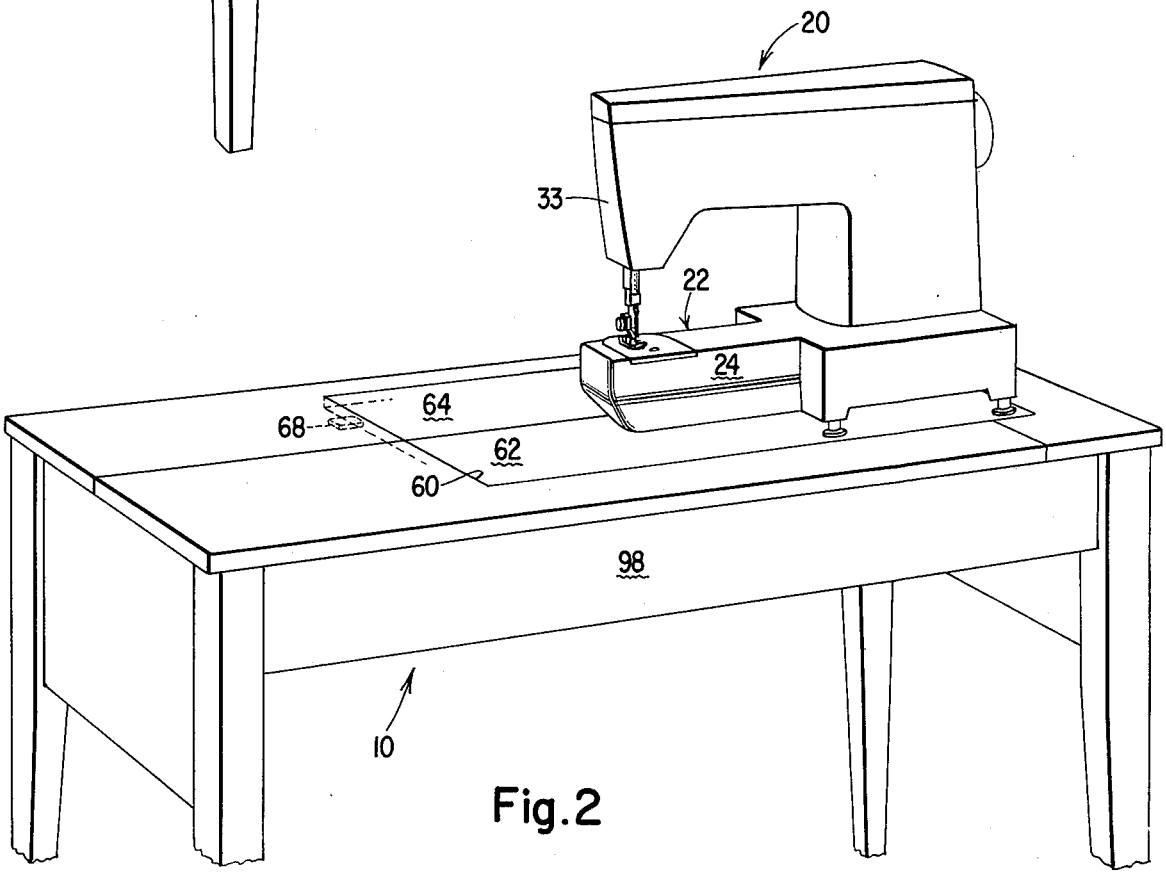
FIG. 2 is a front perspective view as in FIG. 1 with the sewing machine and cabinet in the free arm position.

Referring now to the drawings, FIG. 2 shows a sewing machine cabinet 10 in which there is supported a convertible bed sewing machine 20 similar to the type described in U.S. Pat. No. 3,188,993 of W. D. Szuba et al. The sewing machine 20 has a flat work supporting bed 22 which is composed of a cylinder bed portion 24 and a removable flat bed portion, indicated at 26 in FIG. 3.

The work supporting bed 22 is bounded by a rear laterally disposed edge 28, a front laterally disposed edge 30, a first longitudinal edge 32 adjacent the sewing head 33 which carries sewing instrumentalities including a needle bar 34 and a thread carrying needle 36 attached thereto, and a second longitudinal edge 38 joining the rear and front laterally disposed edges 28 and 30. Part of the first longitudinal edge 32 and the rear and front laterally disposed edges 28 and 30, respectively, are interrupted when the removable flat bed portion 26 is removed.

The cabinet 10 is supported by four legs 40, mounted, for example, by wing nuts 42, and is formed with a fixed rear portion 44 having a rear work supporting surface 46, and a shiftable front portion 48, having a front work supporting surface 50. The sewing machine 20 is supported with its flat work supporting bed 22 in front of and spaced above the rear work supporting surface 46, and, in the position shown in FIG. 2, above the front work supporting surface 50, the front work supporting surface 50 being co-planar with the rear work supporting surface 46. In this position, the removable flat bed portion 26 may be removed leaving the cylinder bed portion 24 exposed.

Figure 3:
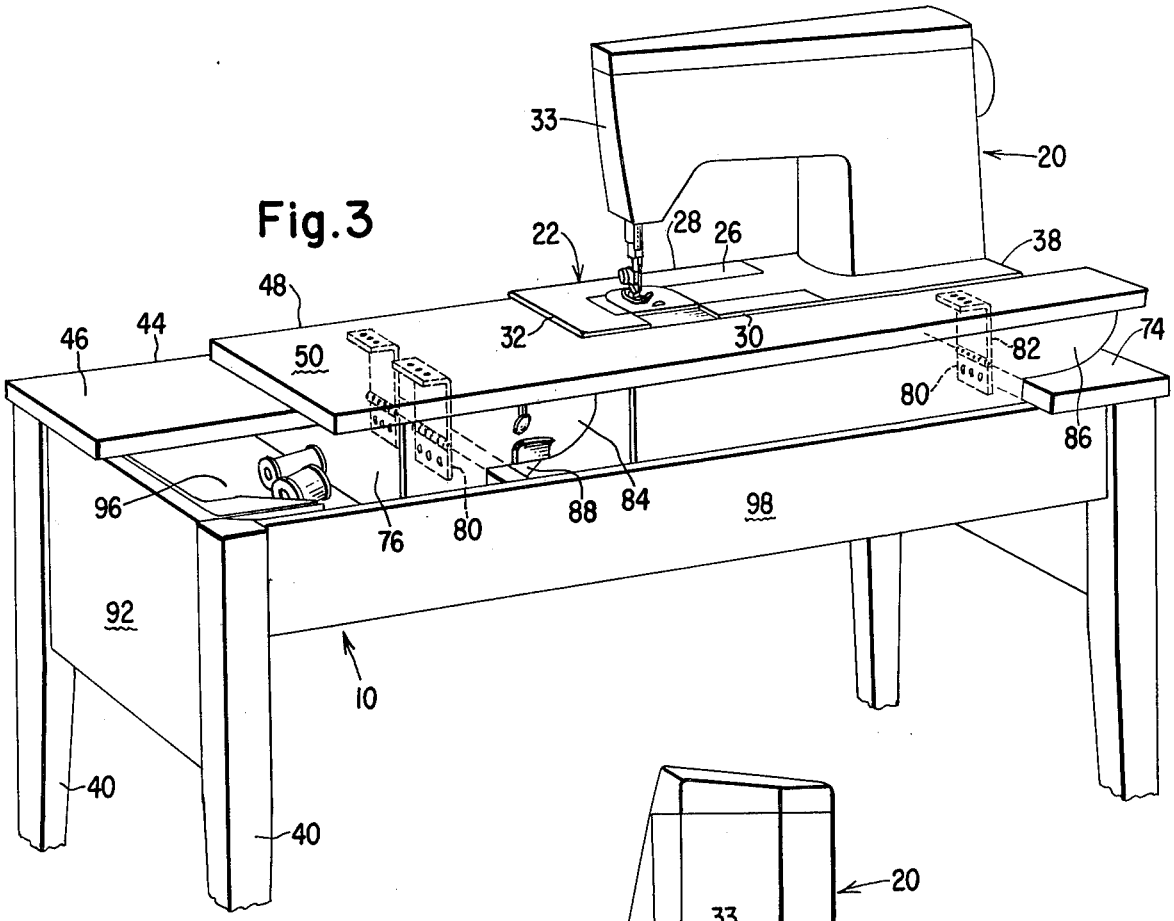
FIG. 3 is a front perspective view of the sewing machine and cabinet converted to a flat bed mode.

In FIG. 3, the cabinet 10 is shown with the front portion 48 laterally shifted parallel to the rear portion 44 to a raised position with the front work supporting surface 50 co-planar with the flat work supporting bed 22 of the sewing machine 20. The height of the sewing machine 20 is not changed by the raising or lowering of the front cabinet portion 48, and remains at the optimum level for operator comfort.

Referring to FIG. 2, when the front portion 48 is in its lowered position, the front work supporting surface 50 being co-planar with the rear work supporting surface 46, there is left an opening 60, closed by a machine platform 62 and an interlocking flap 64, through which a convertible bed sewing machine 20, when fastened to the machine platform 62 by any suitable means, may pass. The interlocking flap 64 is mounted at the rear of opening 60 to the rear portion 44 by hinges 66 which allow the interlocking flap 64 to pivot upwardly. Stops 68 are mounted on opposite sides of the opening 60 for limiting any downward motion of the interlocking flap 64 below the rear work supporting surface 46. Projections 70 are mounted to the front edge 72 of the interlocking flap 64 for supporting the machine platform 62 which is mounted at the forward edge of the opening 60 to a forwardly extending section 74 of the fixed rear portion 44 and to a longitudinally disposed section 76 of the cabinet 10 by hinges 78.

Figure 4:
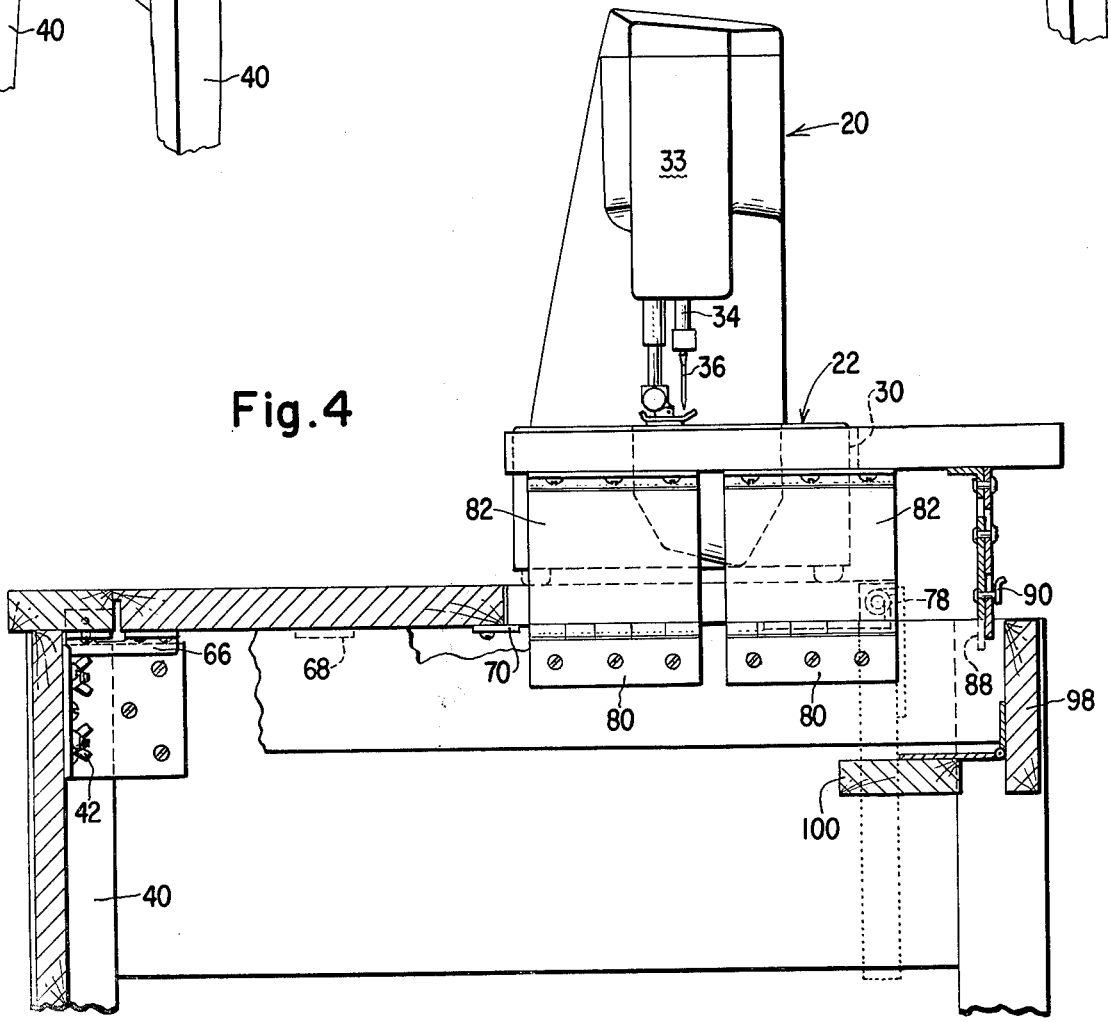
FIG. 4 is a side elevational view partly in section of the sewing machine cabinet showing the support means for the shiftable front work supporting surface.

In FIG. 4, the parallel motion mechanism for laterally raising the front portion 48, includes a set of double hinges 80 having elongated mid-sections 82 attaching the front portion 48 to the rear portion forwardly extending section 74 and to the longitudinally disposed cabinet-section 76. Shield portions 84 and 86 are mounted to the front portion 48 and rest respectively upon the longitudinally disposed cabinet section 76 and the forwardly extending section 74 of the rear portion 44 when the front portion 48 is in its elevated position. The purpose for the shield portions 84 and 86 is both to support the shiftable front portion 48 in the elevated position and to close the resulting gap between the elevated shiftable front portion 48 and the rest of the cabinet 10. A gravity acting slide bolt 88 is mounted to the shield portion 84 and abuts the longitudinally exposed cabinet section 76 preventing the front portion 48 from being lowered inadvertently. By lifting the handle 90, the slide bolt 88 is retracted and the front portion 48 may be lowered.

A space may be provided between the longitudinally disposed cabinet section 76 and the cabinet side 92 in which may be mounted a storage box 96 which is closed by the front portion 48.

The front rail 98 of the cabinet 10, which shields the stored sewing machine from view, is provided with a pivotally mounted lower portion 100 which may be pivoted up rearwardly to provide for greater operator leg clearance when using the cabinet 10.

A table insert 102 is also provided for closing the opening 60 when the machine platform 62 carrying the sewing machine 20 is in its storage position.

Figure 5:
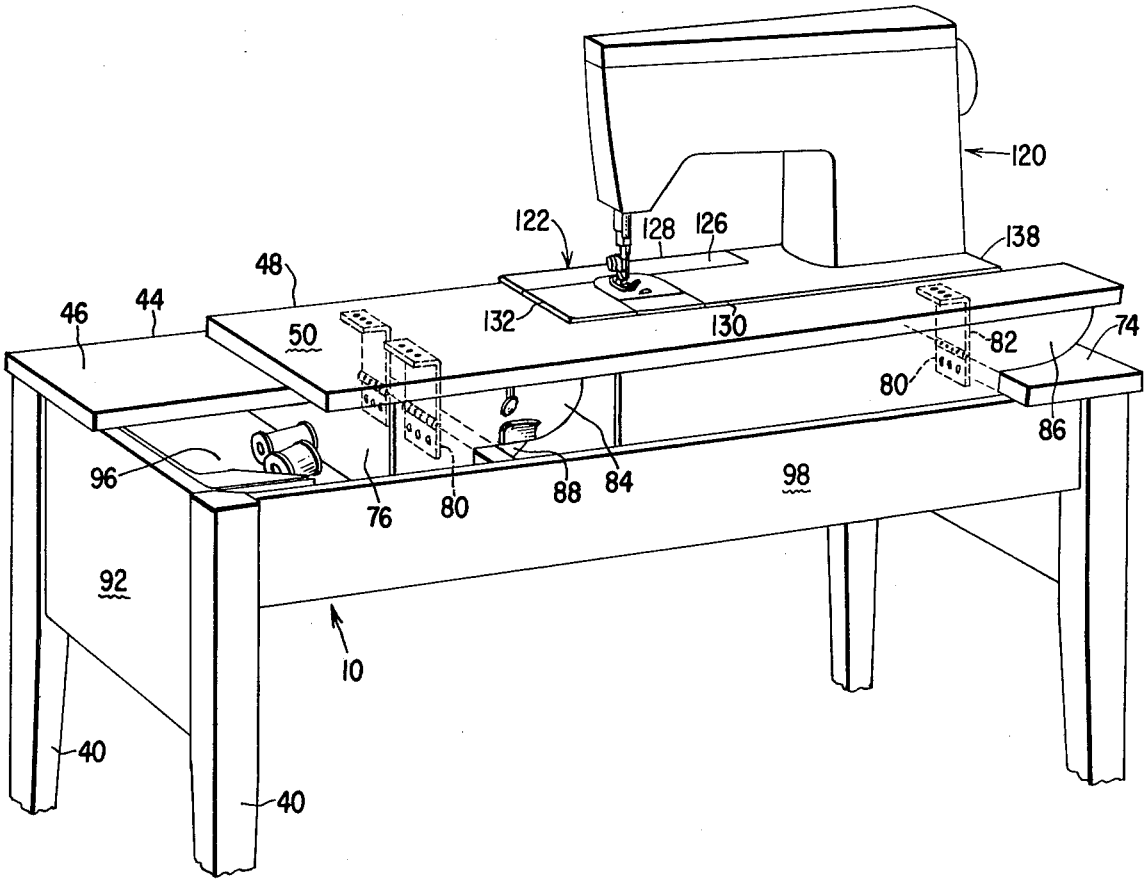
FIG. 5 is a front perspective view of the sewing machine cabinet being used with a convertible bed sewing maching having a flip-down door in the bed thereof.

As shown in FIG. 5, this cabinet 10 may also be used with a sewing machine 120 having a flip-down door 126 for converting the work supporting bed 122 from a flat bed mode to a free-arm mode. Edges 130 and 132 will then abut the shiftable front portion 48 when the cabinet 10 is in the flat bed mode.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is herein claimed is:

1. A cabinet for a sewing machine having a work supporting bed formed with a rear laterally disposed edge, a front laterally disposed edge, and first and second longitudinal edges joining said laterally disposed edges, said work supporting bed being convertible from a flat bed configuration to a cylinder bed configuration, said cabinet comprising:

a rear, laterally elongate, cabinet portion having a rear supporting surface;

means for pivotally supporting said sewing machine in a first position with said sewing machine retracted from view and in a second position with said rear laterally disposed edge of said work supporting bed adjacent to and forwardly of said rear cabinet portion, with said first longitudinal edge forwardly of said rear cabinet portion, and with said work supporting bed spaced above said rear work supporting surface; and a vertically shiftable front, laterally elongate, cabinet portion having a front work supporting surface, said shiftable front cabinet portion, when in a lowered position, being located forwardly of and contiguous to said rear cabinet portion laterally beyond said sewing machine first longitudinal edge to the lateral end of said rear cabinet portion, said front work supporting surface being coplanar with said rear work supporting surface whereby said work supporting bed is spaced above said work supporting surfaces of both said rear and front cabinet portions.

2. A cabinet as set forth in claim 1, wherein said front cabinet portion is supported selectively in a first position with said front work supporting surface co-planar with said rear work supporting surface, both of said front and rear work supporting surfaces being spaced below said work supporting bed, and in a second position with said front work supporting surface co-planar with said work supporting bed and contiguous said first longitudinal edge of said sewing machine work supporting bed.

3. A cabinet as set forth in claim 1, which further comprises a front rail, said front rail having a fixed upper portion and a lower portion pivotally mounted below said front rail upper portion, whereby, when said supporting means is in said second position, said lower portion may be pivoted to a retracted position allowing greater clearance under said cabinet for an operator.

* * * * *